US005850890A

United States Patent [19]

Couttet

[11] Patent Number: 5,850,890

[45] Date of Patent: Dec. 22, 1998

[54] SELF-LOCKING ABSEIL DEVICE

[75] Inventor: Vincent Couttet, Chamonix Mont Blanc, France

[73] Assignee: Alp' Tech, Paris, France

[21] Appl. No.: 732,249

[22] PCT Filed: Apr. 26, 1995

[86] PCT No.: PCT/FR95/00543

§ 371 Date: Oct. 21, 1996

§ 102(e) Date: Oct. 21, 1996

[87] PCT Pub. No.: WO95/28990

PCT Pub. Date: Nov. 2, 1995

[30] Foreign Application Priority Data

Apr. 27, 1994 [FR] France ..... 94 05331

[51] Int. Cl.[6] ..... A47L 3/04

[52] U.S. Cl. ..... 182/5; 182/191; 182/192; 188/65.4

[58] Field of Search ..... 182/3, 5, 6, 7, 182/133, 134, 135, 136, 191, 192, 193; 188/65.4, 65.5

[56] References Cited

U.S. PATENT DOCUMENTS

| | | | |
|---|---|---|---|
| 3,811,155 | 5/1974 | Stafford | 182/5 X |
| 3,926,278 | 12/1975 | Molnar et al. | 188/65.5 X |
| 3,946,989 | 3/1976 | Tsuda | 182/5 X |
| 4,059,871 | 11/1977 | Swager | 182/5 X |
| 4,077,094 | 3/1978 | Swager | 182/5 X |
| 4,253,218 | 3/1981 | Gibbs | 182/5 X |
| 4,334,595 | 6/1982 | Koch | 182/5 |
| 4,394,992 | 7/1983 | Fohl | 188/65.4 X |
| 4,542,884 | 9/1985 | Dodge, Jr. | 182/5 X |
| 4,667,772 | 5/1987 | Kammerer . | |
| 5,146,655 | 9/1992 | Gibbs . | |

FOREIGN PATENT DOCUMENTS

| | | |
|---|---|---|
| 2568132 | 1/1986 | France . |
| 2631325 | 11/1989 | France . |

*Primary Examiner*—Daniel P. Stodola
*Assistant Examiner*—Richard M. Smith
*Attorney, Agent, or Firm*—William H. Eilberg

[57] ABSTRACT

An abseil device including an integral main body (1) with two generally parallel main flanges (3, 4) joined together via a longitudinal connecting flange (6) and provided with two apertures (13, 14) engaged by a hook ring (2). The apertures (13, 14) include slanted edges (12) along which the hook ring (2) is slidable for wedging an intermediate portion (17) of a rope (5) and thereby locking the abseil device thereon. The device can be released by pivoting the main body (1). A self-locking abseil device suitable for mountaineering, caving, rock climbing or work in places high above the ground is thus provided.

14 Claims, 7 Drawing Sheets

SELF-LOCKING ABSEIL DEVICE

TECHNICAL FIELD OF THE INVENTION

The present invention concerns abseil devices, which are devices generally used for mountaineering, caving, rock climbing or work in places high above the ground, in particular enabling descent along a rope with a braking action on the rope.

The figure-of-eight abseil devices most frequently used enable only braking along the rope, the braking force being adjustable by deliberate action of the user on the rope itself. To obtain the braking action the user must hold the rope. If the user lets go of the rope the braking effect is insufficient to stop the abseil device sliding down the rope and the device can slide to the end of the rope at too high a speed, in which case the descent of the user is followed by a fall.

More complex abseil devices have been proposed, comprising moving parts and pull cord systems for adjusting the braking force. These abseil devices are always too complex to be totally safe in use, since the user has to be experienced to use them correctly.

Document U.S. Pat. No. 4,667,772 describes a self-locking device for ascending a rope. This device has a integral main body with two generally parallel main flanges held the appropriate distance apart for the rope to slide between them and a longitudinal connecting flange linking two longitudinal sides of the two main flanges and forming a groove through which the rope passes. Two ring guide openings are provided on the respective main flanges in corresponding relationship to each other. Each has at least one oblique edge progressively converging with the connecting flange in the direction towards the rope entry end as far as a locking end. The ring guide openings are sized to receive a portion of the locking ring that passes through them and that can slide to the locking end where the ring clamps the rope against the connecting flange.

In the above document the connecting flange is generally rectilinear and has asperities increasing the friction force on the rope. The lateral flanges are away from the rope.

A device of this kind, designed for ascending a rope, assures effective locking but is not appropriate for controlled sliding along a rope. The locking force varies too suddenly between effective locking and unlocking with virtually no braking force.

SUMMARY OF THE INVENTION

The problem to which the present invention is addressed is that of designing a new abseil device structure that combines great simplicity, great safety in use by avoiding any possibility of error, and enhanced efficacy by assuring effective adjustable progressive braking and positive automatic locking in response to lack of appropriate action by the user.

In accordance with the invention, the abseil device must therefore be able to lock up automatically if the user does not control its location and its orientation along the rope, controlled and braked sliding of the abseil device along the rope being permitted by an intentional action of the user.

In accordance with the invention, this positive safety must be achieved by an abseil device that is particularly simple, having no moving parts.

To achieve the above and other objects, the self-locking abseil device of the invention enables relative locking of a ring to which the user is attached and at least one rope. The abseil device comprises a integral main body with:

two generally parallel main flanges separated by a distance allowing the rope to slide between them, a longitudinal connecting flange joining together two longitudinal sides of the two main flanges and forming a groove in which the rope passes between an entry end and an exit end, two ring guide openings in respective main flanges and in corresponding relationship to each other, each including at least on oblique edge progressively converging with the longitudinal connecting flange in the direction towards the rope entry end and as far as a locking end, the ring guide openings being sized to receive a portion of the hook ring passing through them and which can slide as far as the locking end in which the ring clamps the rope against the longitudinal connecting flange;

the longitudinal connecting flange has a concave inner transverse profile with convergent flanks forming at least one dihedron for wedging the rope; two opposite transverse connecting flanges each joining together two respective transverse sides of the main flanges, forming transverse wedging grooves and constituting the rope entry and rope exit guide portions.

The openings are preferably symmetrical, having an isosceles triangle shape with a central apex in which the hook ring is accommodated in a safety rope braking position and with two opposite locking ends. In this way the abseil device is symmetrical so that it can be used for either direction of movement of the rope.

To use the same device as a safety rope braking device, it may further include spring connecting means for joining an intermediate portion of the longitudinal connecting flange to the body of the user, constituting an orientation balancing unit so that the user may simply hold the entry and exit rope portions.

The convergent flanks of the longitudinal connecting flange can advantageously have respective parallel longitudinal undulations, forcing the rope to follow a somewhat sinusoidal path. This enhances the braking effect of the wedging of the rope between the convergent flanks of the longitudinal connecting flange.

Use in the descent position is facilitated by providing a longitudinal connecting flange extended at both ends by two rope retaining brackets. The rope can then be passed over an opposite bracket before it enters the groove between the main flanges, causing slight pivoting of the abseil device away from the locking orientation.

The main flanges can advantageously have notches for the rope to pass through at their ends opposite the longitudinal connecting flange. The rope is passed over this notch just before entering the groove between the main flanges. This embodiment achieves automatic locking in the absence of user action and requires the user to pivot the abseil device to release it for braked sliding along the rope.

BRIEF DESCRIPTION OF THE DRAWINGS

Other objects, features and advantages of the present invention will emerge from the following description of particular embodiments given with reference to the accompanying drawings, in which.

DESCRIPTION OF THE PREFERRED EMBODIMENTS

Figure 1:
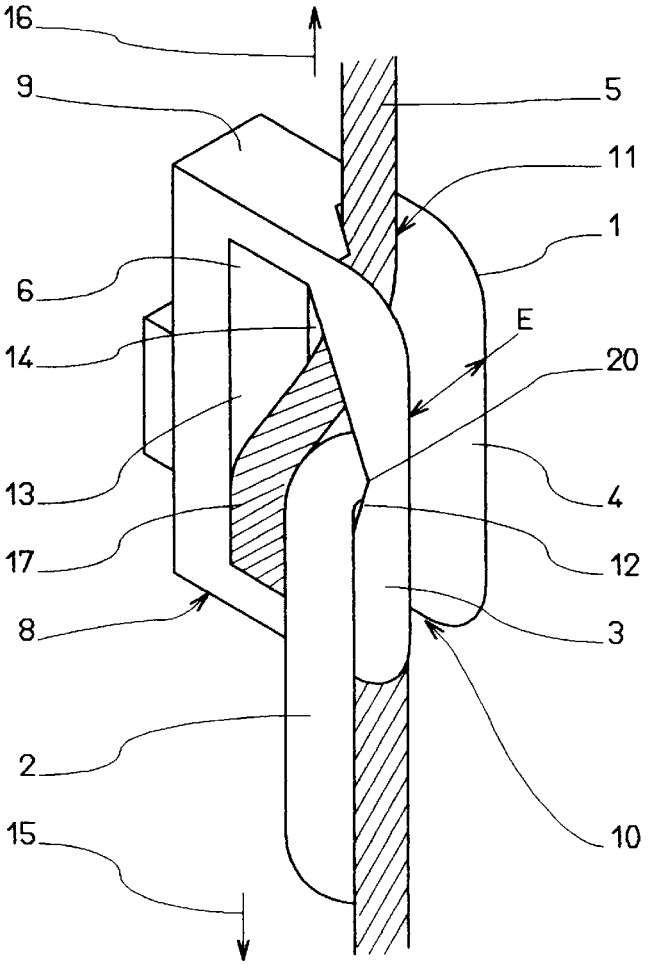
FIG. 1 shows a first embodiment of an abseil device in accordance with the invention in perspective in a locked position.

In the embodiment shown in FIGS. 1 through 5, the abseil device of the invention comprises an integral main body 1 associated with a hook ring 2, preferably a carabiner type hook ring with an opening finger.

The main body 1 has two generally parallel main flanges 3 and 4 separated by a distance E such that a rope 5 can slide between them.

Figure 4:
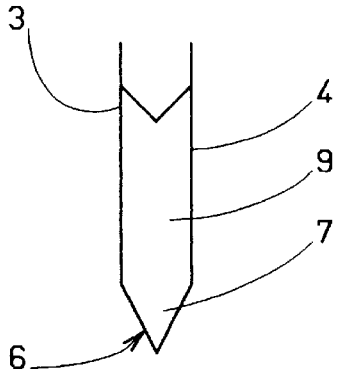
FIG. 4 is a cross-section of the abseil device from FIG. 1.
Figure 5:
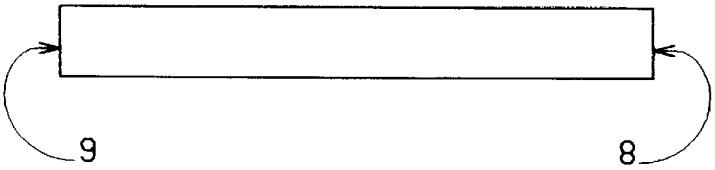
FIG. 5 is a view of the abseil device from FIG. 1 as seen from the open side.

A longitudinal connecting flange 6 joins the two main flanges 3 and 4 together, forming a groove 7 through which the rope passes, seen more clearly in the FIG. 4 cross-section. In this embodiment the longitudinal connecting flange 6 joins together two respective longitudinal sides of the main flanges 3 and 4.

In this embodiment the longitudinal connecting flange 6 has a rectilinear longitudinal profile and a concave transverse profile with converging flanks forming a rope wedging dihedron, as seen in FIG. 4.

The abseil device further comprises two opposite transverse connecting flanges 8 and 9, each joining together two respective transverse sides of the main flanges 3 and 4, forming transverse wedging grooves.

The main body 1 further comprises a rope entry end 10 and a rope exit end 11, generally opposite each other in a longitudinal direction or a general direction of the rope 5 and shaped to orient the main body 1 along the rope 5 in said longitudinal direction.

The free ends of the transverse connecting flanges 8 and 9, which are advantageously in a V-shape configuration, constitute rope entry and exit guide portions.

The main body 1 further comprises openings 13 and 14 in corresponding relationship in the respective main flanges 3 and 4. The openings 13 and 14 have oblique edges such as the edge 12 progressively converging with the longitudinal connecting flange 6 in the direction towards the rope entry end 10, as seen in the figures.

In the position of use, the hook ring 2 passes through the openings 13 and 14 and the rope 5 passes through it. The rope 5 is inserted between the main flanges 3 and 4. When the hook ring 2 is pulled in a traction direction shown by the arrow 15 with the rope 5 held in the opposite direction shown by the arrow 16 the hook ring 2 guided by the guide surface formed by the oblique edge 12 wedges an intermediate portion 17 of the rope 5 between the hook ring 2 and the longitudinal connecting flange 6 forming a wedging groove. The greater the traction on the hook ring 2, the stronger the wedging action, with the result that the abseil device is locked to the rope 5.

Figure 2:
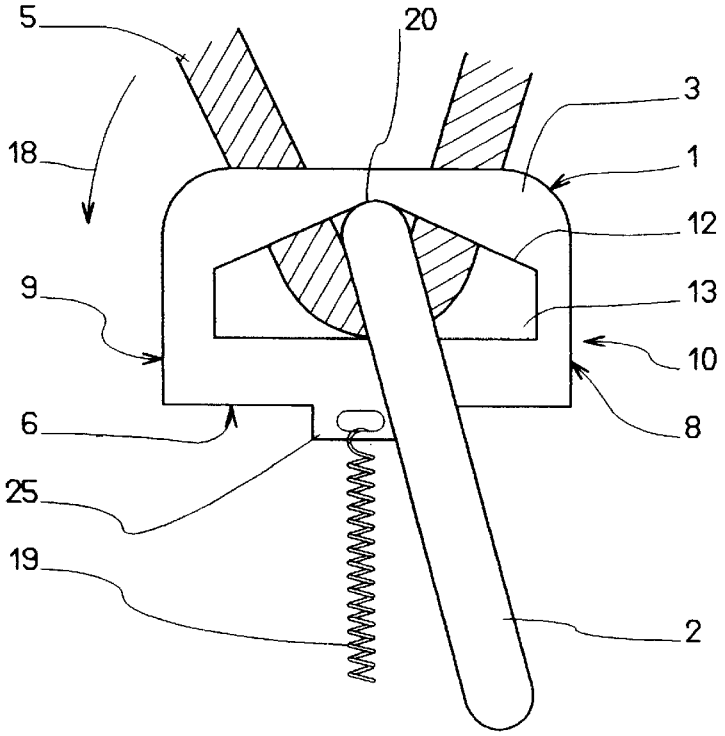
FIG. 2 shows the abseil device from FIG. 1 in a free sliding position.
Figure 3:
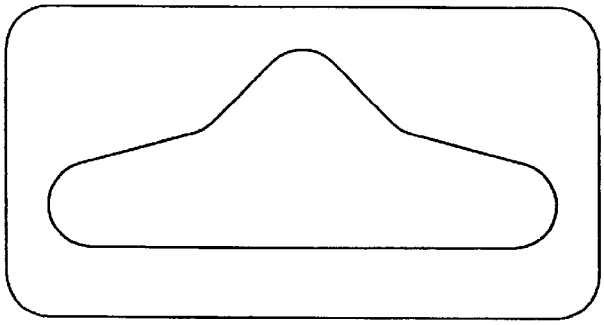
FIG. 3 is a front view of the abseil device from FIG. 1.

Pivoting the main body 1 as shown by the arrow 18 in FIG. 2 progressively reduces the pressure exerted on the rope 5 between the hook ring 2 and the main body 1 and therefore progressively reduces the braking force between the rope 5 and the abseil device, allowing the abseil device to slide along the rope 5, but still with an appropriate braking force.

Accordingly, the abseil device previously described enables abseiling along a fixed rope 5.

Another possible use of the same abseil device is to lock a safety rope. The abseil device is then used as shown in FIG. 2, the entry and exit runs of the rope 5 being guided by the hands of the user. The main body 1 and the hook ring 2 allow the rope 5 to slide as long as the main body 1 is oriented transversely to the runs of the rope, as shown in FIG. 2. Braking can be obtained by pivoting the main body 1 to return it to the position shown in FIG. 1. To facilitate holding it in the sliding position shown in FIG. 2, elastic connection means 19 are advantageously provided to connect an intermediate portion 25 of the longitudinal connecting flange 6 to the body of the user, thus constituting an orientation balancing unit enabling use of the abseil device as a safety rope braking unit without it being necessary to hold the main body 1 of the abseil device in the hand during sliding. When a braking force is required on the rope 5, it is sufficient to let go of the rope where it enters the main body 1 and which, by pressing on the rope entry end 10, causes the main body 1 to pivot in the opposite direction to the arrow 18. The carabiner 2 then slides and engages in the locking position shown in FIG. 1.

Figure 7:
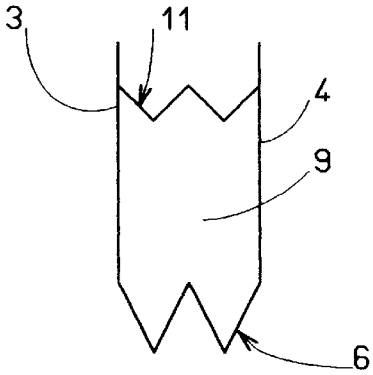
FIG. 7 is a cross-section of the abseil device from FIG. 6.
Figure 8:
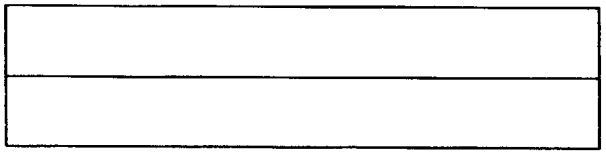
FIG. 8 is a view of the abseil device from FIG. 6 as seen from the open side.
Figure 6:
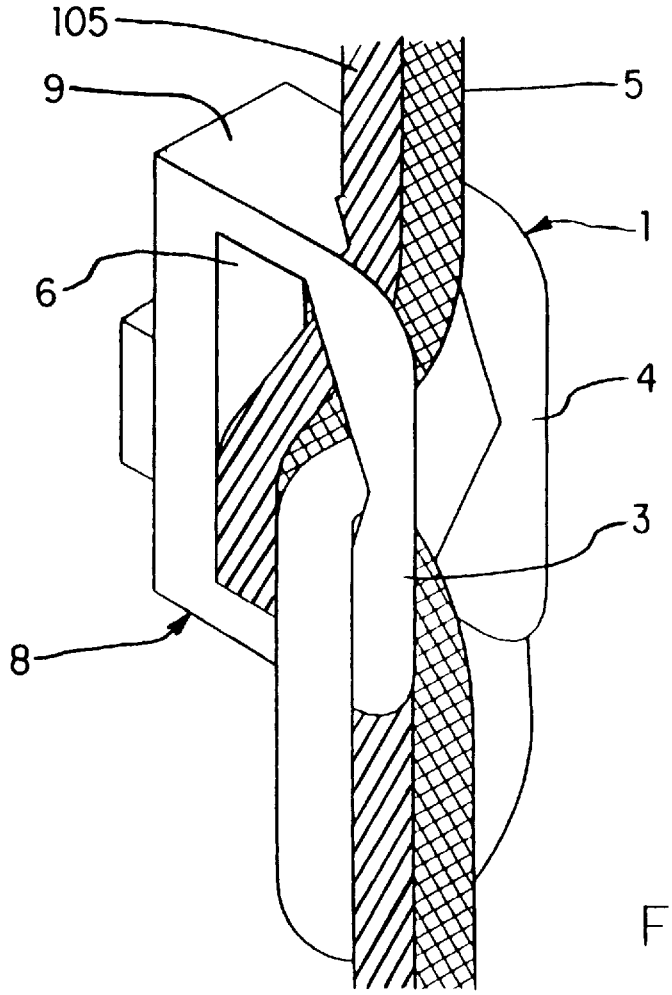
FIG. 6 is a perspective view of an embodiment of an abseil device designed to slide on two runs of rope, shown in a locked position.

FIGS. 6 through 8 show an embodiment of the abseil device of the invention designed to be used on two parallel runs of rope 5 and 105. In this case the main flanges 3 and 4 are sufficiently far apart to accommodate the two runs of rope 5 and 105 side by side, as shown in FIG. 6, and the longitudinal connecting flange 6 can advantageously have a double dihedron transverse profile for wedging the two parallel runs of rope 5 and 105 as shown in FIG. 7.

The rope entry and exit guide portions are formed by the two free ends of the transverse flanges 8 and 9, which advantageously have a W-shape configuration as shown in FIG. 7.

In all the embodiments previously described the openings 13 and 14 are advantageously symmetrical, having an isosceles triangle shape with a central apex 20 in which the hook ring 2 is accommodated in the safety rope braking position, as shown in FIG. 2.

In the embodiment shown in FIGS. 9 through 14 the main features of the abseil device previously described are retained, namely the two main flanges 3 and 4 joined together by a longitudinal connecting flange 6 forming a groove through which the rope passes between the two ends 10 and 11. It also includes the transverse connecting flanges 8 and 9 in a V-shape configuration with a rounded bottom.

This embodiment incorporates three advantageous improvements.

Figure 9:
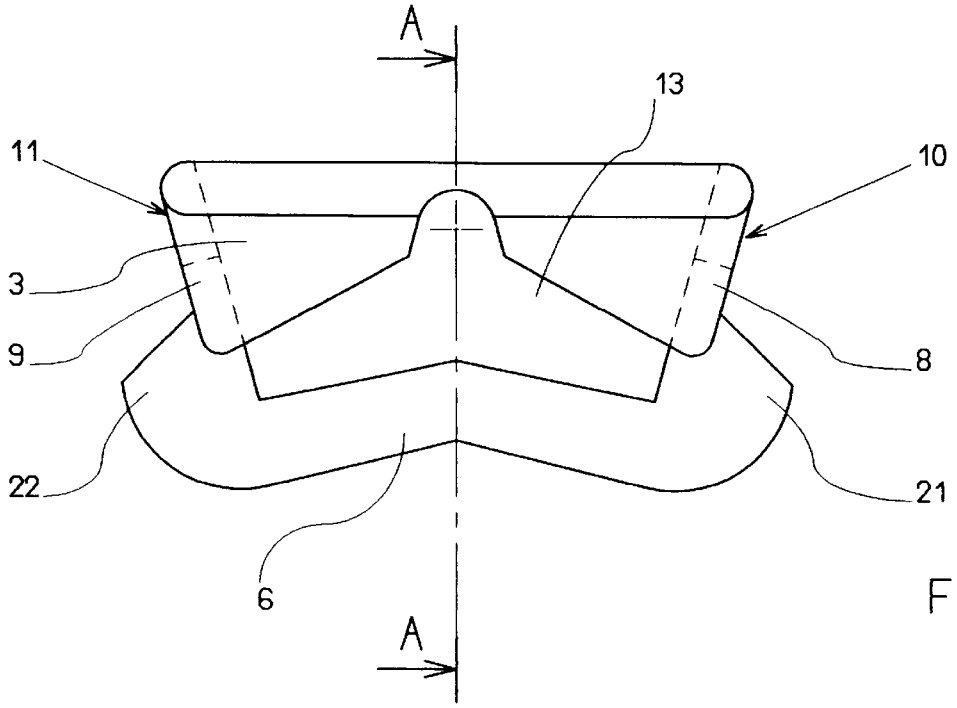
FIG. 9 is a front view of a second embodiment of an abseil device of the invention.
Figure 10:
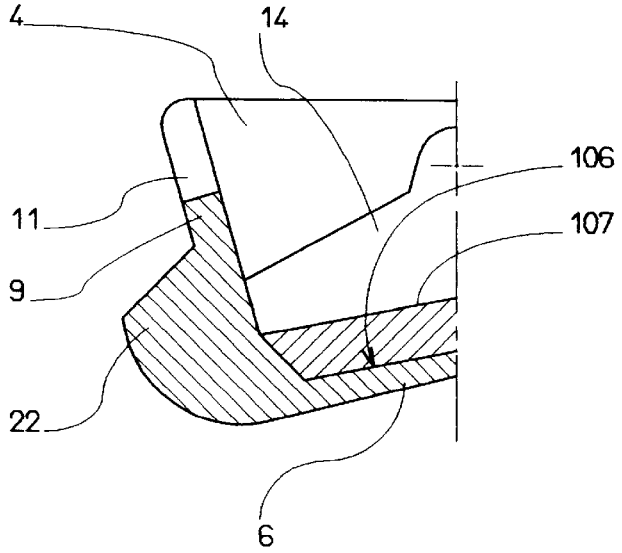
FIG. 10 is a view of the abseil device from FIG. 9 in longitudinal half-section on the median plane B—B in FIG. 14.
Figure 11:
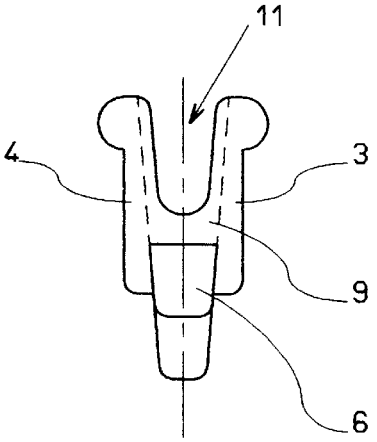
FIG. 11 is a side view of the abseil device from FIG. 9.
Figure 12:
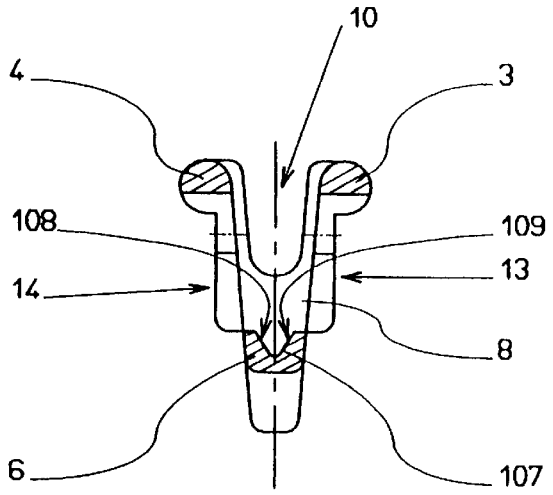
FIG. 12 is a cross-section on A—A in FIG. 9.

In an embodiment shown in FIGS. 9 and 10 in particular, the longitudinal connecting flange 6 has a triangular longitudinal profile with a convex inside edge 106 and a central apex 107.

Figure 13:
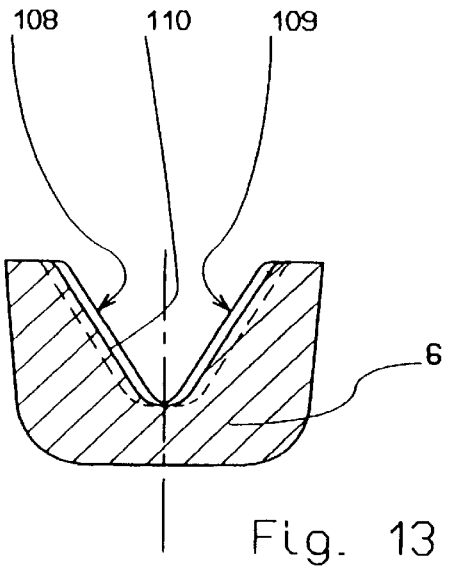
FIG. 13 shows part of FIG. 12 to a larger scale, showing the back wall of the locking groove of the abseil device in more detail.
Figure 14:
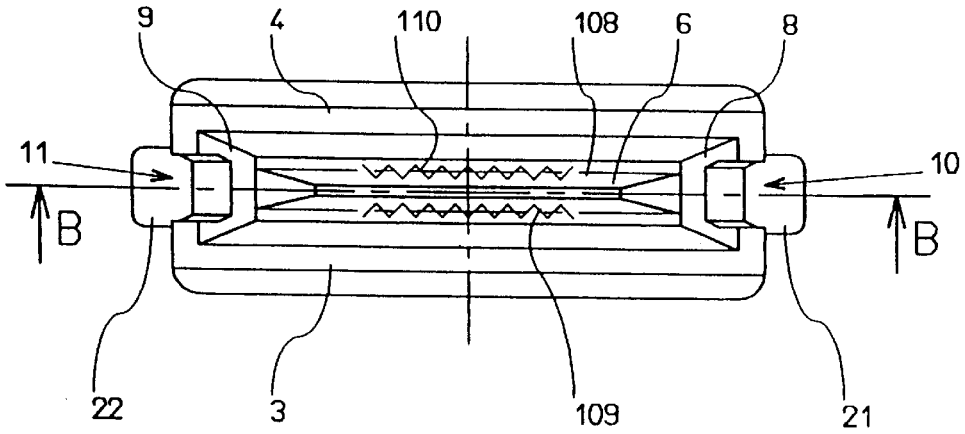
FIG. 14 is a top view of the abseil device from FIG. 9.

In accordance with a first improvement, the convergent flanks 108 and 109 of the longitudinal connecting flange 6 have respective parallel longitudinal undulations 110, as shown in FIGS. 13 and 14.

In accordance with a second improvement, the longitudinal connecting flange 6 is extended at both ends by two rope retaining brackets 21 and 22.

Figure 15:
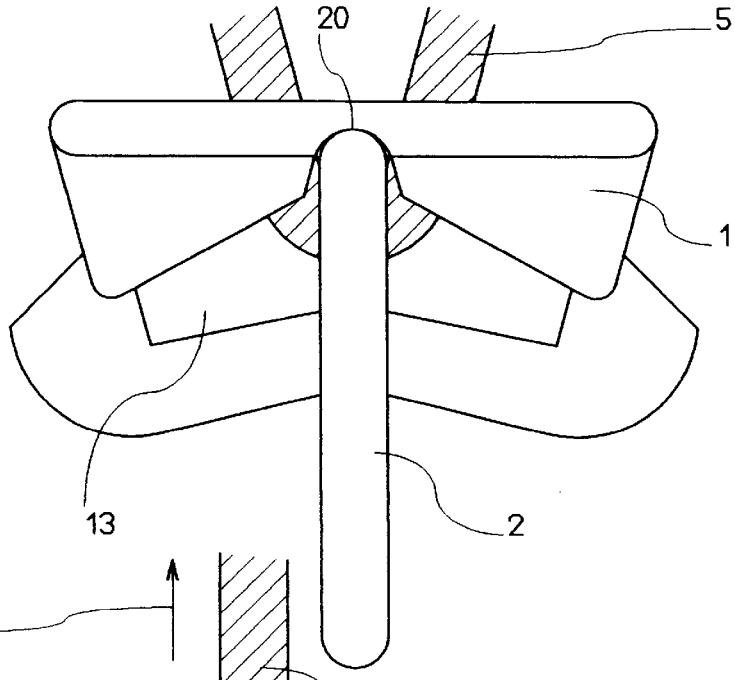
FIG. 15 shows the abseil device from FIG. 9 in a free sliding position.
Figure 16:
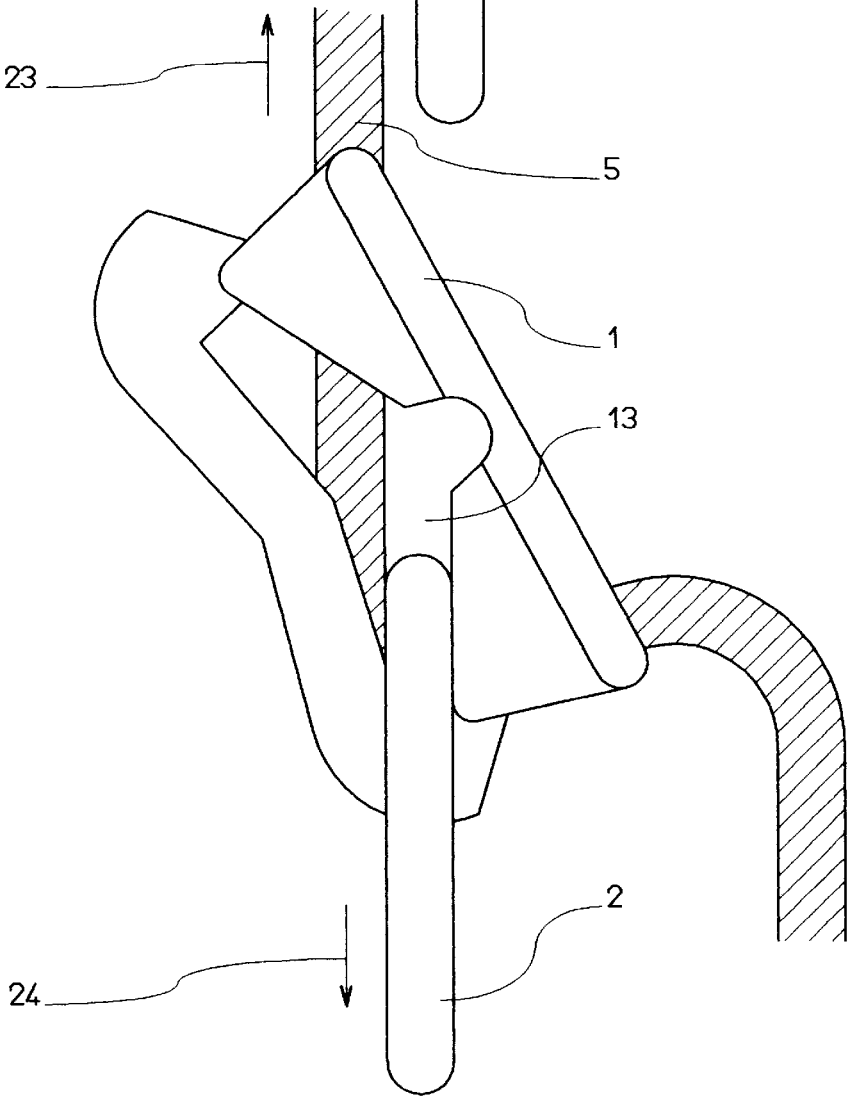
FIG. 16 shows the abseil device from FIG. 9 in a locking position.
Figure 17:
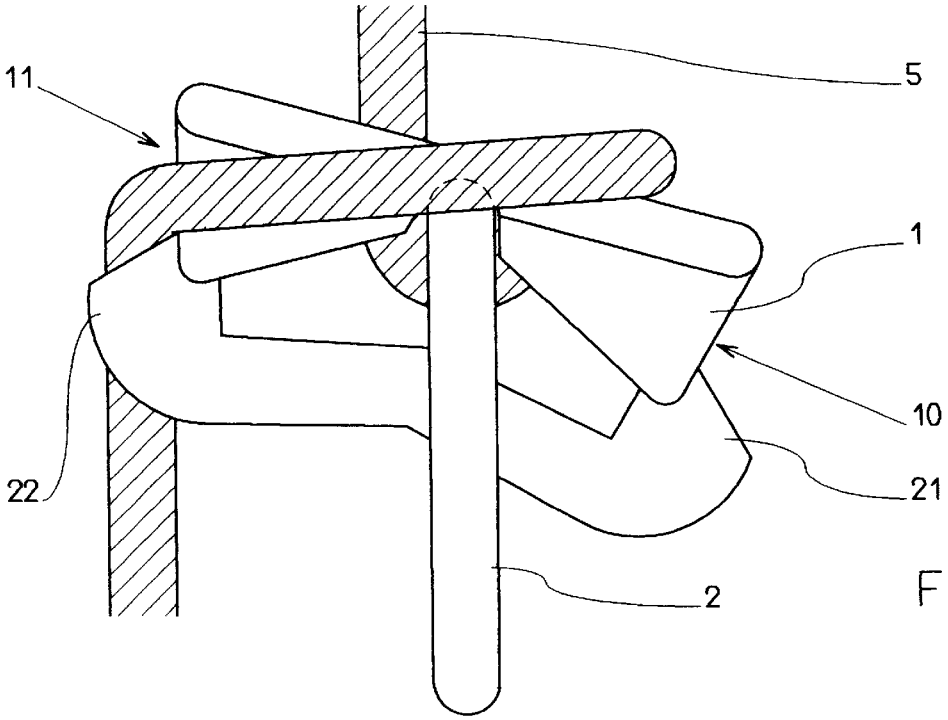
FIG. 17 shows the abseil device from FIG. 9 in a controlled braking position.

The use of the abseil device from FIGS. 9 through 14 is illustrated in FIGS. 15 through 17.

In FIG. 15, the abseil device is shown in the free sliding position in which the hook ring 2 is located at the apex 20 of the opening 13, the abseil device being in an equilibrium transverse position and exerting no braking action on the rope 5. Retaining it in this position requires the user to hold the two runs of the rope 5 in the position shown in FIG. 15.

If the user lets go of one run of the rope 5, the abseil device tilts into the FIG. 16 position. Traction 23 exerted on the rope opposing traction 24 exerted on the hook ring 2 locks the rope 5 by causing engagement of the hook ring 2 in the locking position. This mode of operation can advantageously be used by the leading climber.

FIG. 17 shows the abseil device in the abseiling position, in which controlled braking is applied. To this end, the lower entry run of the rope 5 is passed first behind the bracket 22 opposite the entry end 10, laterally along the outside face of one of the main flanges 3, into the rope passage between the two main flanges 3 and 4, through the hook ring 2 and out of the device in the upward direction.

If the rope 5 were to escape from the bracket 22, the device would return to the position shown in FIG. 13 and lock up automatically.

Figure 18:
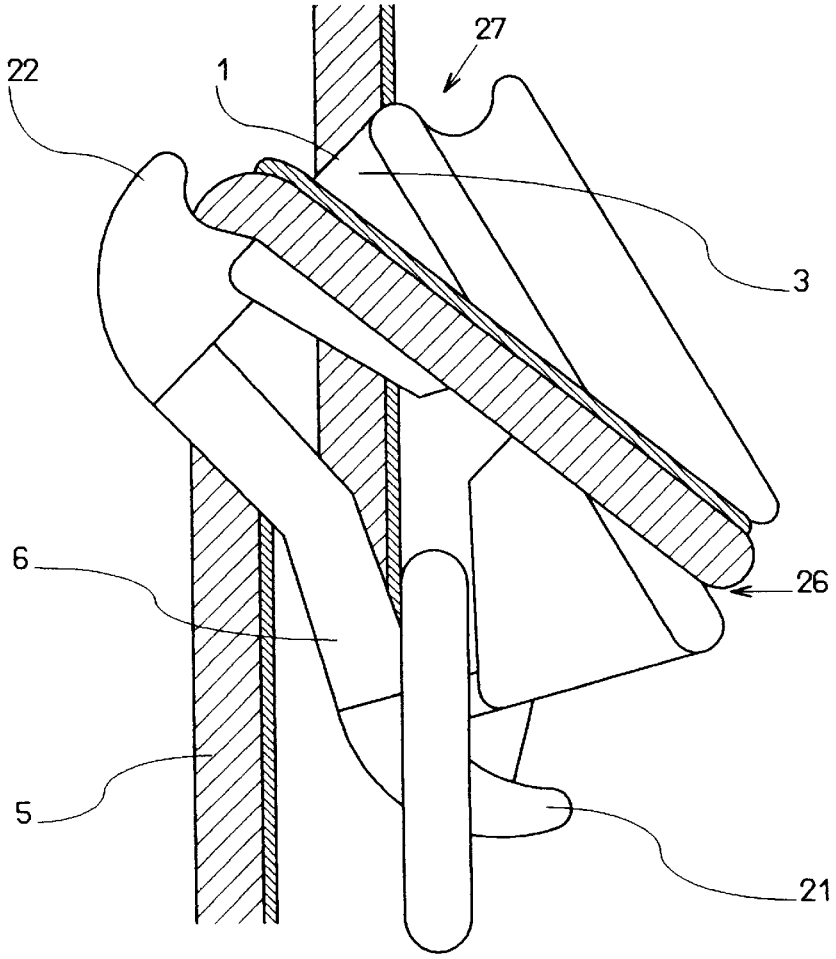
FIG. 18 shows a third embodiment of an abseil device of the invention in a controlled braking position.

In the embodiment shown in FIG. 18 the abseil device has substantially the same component parts as the FIG. 9 embodiment plus two additional features: firstly, the brackets 22 and 21 are more accentuated, for improved guidance of the rope 5; secondly, and more importantly, the main flanges such as the main flange 3 have notches 26 and 27 at the end opposite the longitudinal connecting flange 6 and through which the rope 5 passes. Inserting the rope 5 in the notch 26 increases the braking force compared to the FIG. 9 embodiment and the more hollowed out shape of the notch 22 prevents the rope 5 escaping from the notch 22. This type of abseil device locks automatically if the user lets go of the rope and the abseil device. Controlled sliding along the rope requires the user to pivot the main body 1 of the abseil device in order to lower the bracket 22.

The main body 1 can be made from various materials. Good braking and locking can be obtained with an aluminium alloy main body.

The abseil device of the invention has an enhanced locking capability by virtue of its shape alone, and in particular achieves braking by a wedging effect in which the braking force is applied to the core of the rope, unlike rough surfaced devices which operate primarily on the outer sheath of the rope and may damage it.

The present invention is not limited to the embodiments that have been explicitly described but includes variants and generalisations thereof within the scope of the following claims.

I claim:

1. In combination, a self-locking abseil device for relative locking of a hook ring (2) and at least one rope (5), comprising an integral main body (1) having:

two generally parallel main flanges (3, 4) separated by a distance allowing the rope (5) to slide between them, a longitudinal connecting flange (6) joining together two longitudinal sides of the two main flanges (3, 4) and forming a groove (7) in which the rope (5) passes between an entry end (10) and an exit end (11), two ring guide openings (13, 14) in respective main flanges (3, 4) and in corresponding relationship to each other, each including at least one oblique edge (12) progressively converging with the longitudinal connecting flange (6) in the direction towards the rope entry end (10) and as far as a locking end, the ring guide openings (13, 14) being sized to receive a portion of the hook ring (2) passing through them, said opening permitting ring sliding as far as the locking end in which the ring clamps the rope (5) against the longitudinal connecting flange (6), wherein:

the longitudinal connecting flange (6) has a concave inner transverse profile with convergent flanks forming at least one dihedron for wedging the rope (5), two opposite transverse connecting flanges (8, 9) each joining together two respective transverse sides of the main flanges (3, 4), forming transverse wedging grooves and constituting the rope entry (10) and rope exit (11) ends.

2. The combination of claim 1 wherein the openings (13, 14) are symmetrical, having an isosceles triangle shape with a central apex (20) in which the hook ring (2) is accommodated in a safety rope locking position, said openings having two opposite locking ends.

3. The combination of claim 1 wherein it further comprises spring connecting means (19) for joining an intermediate portion (25) of the longitudinal connecting flange (6) to a body of a user, constituting an orientation balancing unit enabling use of the abseil device as a safety rope locking unit.

4. The combination of claim 1 wherein the longitudinal connecting flange (6) has a double dihedron transverse profile for wedging two parallel runs of rope (5, 105).

5. The combination of claim 1 wherein the convergent flanks (108, 109) of the longitudinal connecting flange (6) have respective parallel longitudinal undulations (110).

6. The combination of claim 1 wherein the longitudinal connecting flange (6) is extended at both ends by two rope retaining brackets (21, 22).

7. The combination of claim 6 wherein the main flanges (3, 4) have notches (26, 27) at the end opposite the longitudinal connecting flange (6), the notches adapted to allow through passage of the rope.

8. A self-locking abseil device comprising an integral main body (1), the main body having:

two generally parallel main flanges (3, 4) separated by a distance, a longitudinal connecting flange (6) joining together two longitudinal sides of the two main flanges (3, 4) and forming a groove (7) and defining an entry end (10) and an exit end (11), two ring guide openings (13, 14) in respective main flanges (3, 4) and in corresponding relationship to each other, each including at least one oblique edge (12) progressively converging with the longitudinal connecting flange (6) in the direction towards the entry end (10) and as far as a locking end, wherein the longitudinal connecting flange (6) has a concave inner transverse profile with convergent flanks forming at least one dihedron, and wherein the abseil device further comprises two opposite transverse connecting flanges (8, 9) each joining together two respective transverse sides of the main flanges (3, 4), forming transverse wedging grooves.

9. The abseil device of claim 8, wherein the openings (13, 14) are symmetrical, having an isosceles triangle shape with a central apex (20), said openings having two opposite locking ends.

10. The abseil device of claim 8, further comprising spring connecting means (19) for joining an intermediate portion (25) of the longitudinal connecting flange (6) to a body of a user.

11. The abseil device of claim 8, wherein the longitudinal connecting flange (6) has a double dihedron transverse profile.

12. The abseil device of claim 8, wherein the convergent flanks (108, 109) of the longitudinal connecting flange (6) have respective parallel longitudinal undulations (110).

13. The abseil device of claim 8, wherein the longitudinal connecting flange (6) is extended at both ends by two retaining brackets (21, 22).

14. The abseil device of claim 8, wherein the main flanges (3, 4) have notches (26, 27) at the end opposite the longitudinal connecting flange (6).

* * * * *